US006472621B2

(12) United States Patent
Merlin et al.

(10) Patent No.: US 6,472,621 B2
(45) Date of Patent: Oct. 29, 2002

(54) START-MOTOR ASSEMBLY

(75) Inventors: Pierre Merlin, Fontaine les Dijon (FR); Serge Paggi, Ruffey les Echirey (FR); Thierry Fort, Rueil-Malmaison (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 09/802,912

(22) Filed: Mar. 12, 2001

(65) Prior Publication Data

US 2001/0022264 A1 Sep. 20, 2001

(30) Foreign Application Priority Data

Mar. 17, 2000 (FR) ..... 00 03563

(51) Int. Cl.[7] ..... H01H 9/20
(52) U.S. Cl. ..... 200/50.32; 335/159
(58) Field of Search ..... 200/50.32, 303, 200/307; 335/131, 132, 16, 147, 159–161, 195; 439/638, 351, 353, 357, 358, 361; 361/600, 601, 622, 625, 631, 634, 627, 652, 656, 673

(56) References Cited

U.S. PATENT DOCUMENTS 4,173,387 A * 11/1979 Zell ..... 339/196 M
5,541,561 A 7/1996 Grunert et al.
5,652,420 A * 7/1997 Innes et al. ..... 200/50.32
5,870,277 A * 2/1999 Girard et al. ..... 361/627
6,140,896 A * 10/2000 Heckenkamp ..... 335/159

FOREIGN PATENT DOCUMENTS

| | | |
|---|---|---|
| DE | 196 00 557 | 7/1997 |
| EP | 0 588 712 A1 | 3/1994 |
| FR | 2 761 539 | 10/1998 |

* cited by examiner

*Primary Examiner*—Elvin Enad
*Assistant Examiner*—Lisa N. Klaus
(74) *Attorney, Agent, or Firm*—Oblon, Spivak, McClelland, Maier & Neustadt, P.C.

(57) ABSTRACT

A switch assembly, particularly for a start-motor including a protection device and a contactor device, and an intermediate component for mechanical association and electrical interconnection between these two devices.

The association component 30 has, to adapt a protection device 10 of fixed size to contactor devices 20 of different sizes, an adjustable part 36. The adjustable part 36 is located at the rear of the component 30, which it may be snapped onto in different positions staggered in depth, and offers a lock-on lug 35 located in the direction of the contactor device 20 and fitted with several support forms 39, 40 staggered in height.

12 Claims, 2 Drawing Sheets

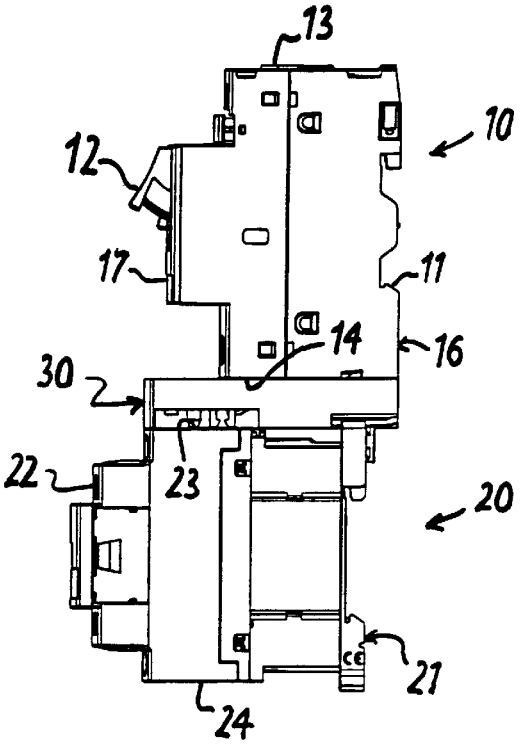
FIG. 1
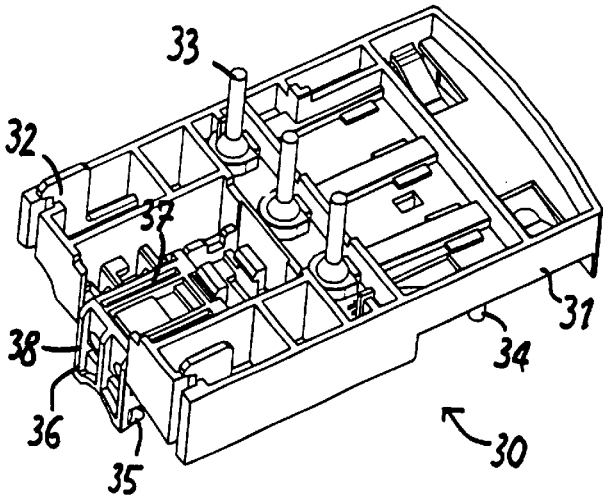
FIG. 2
FIG. 3
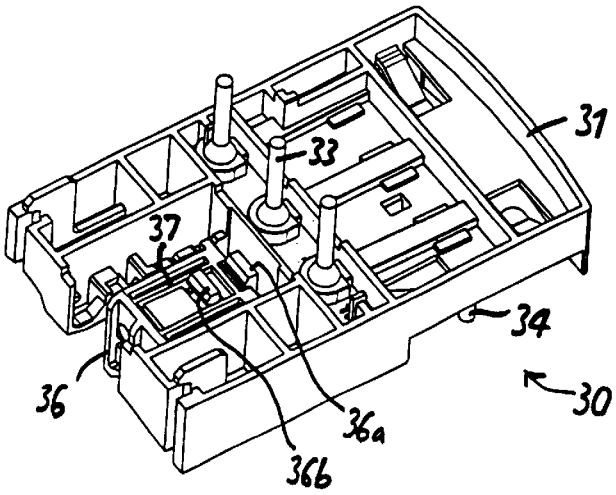

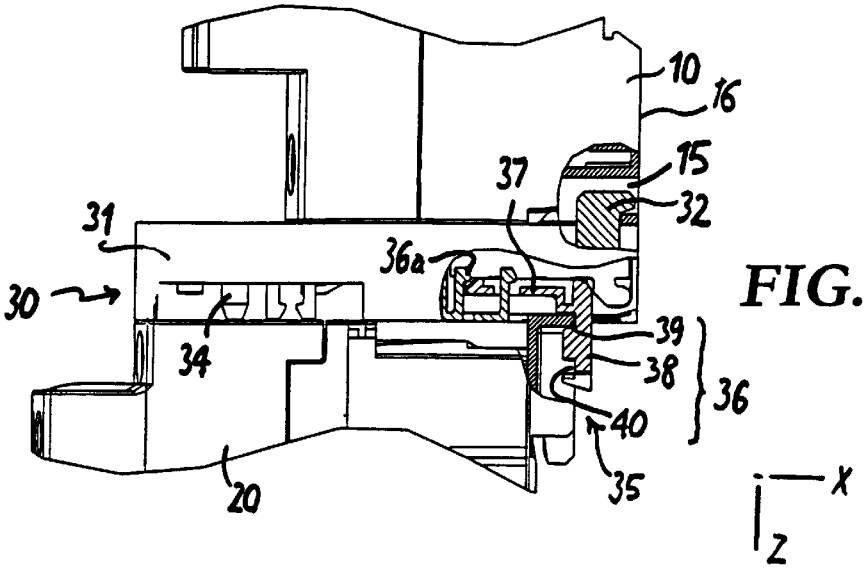
FIG. 4
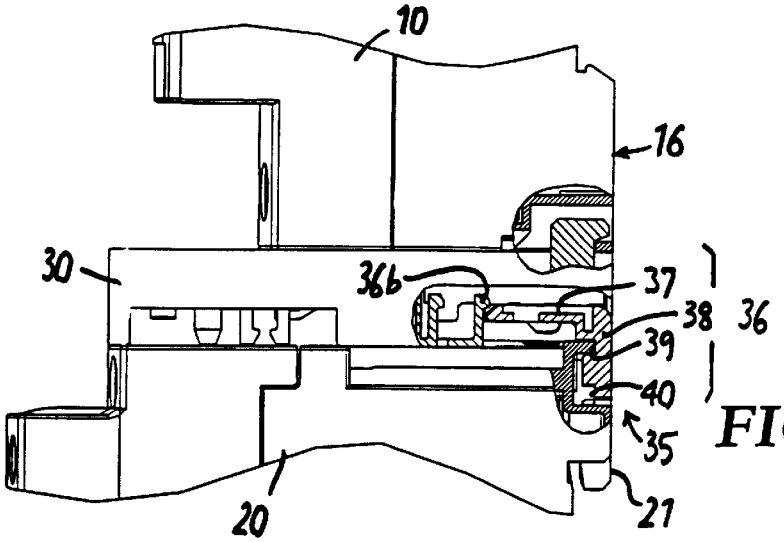
FIG. 5
FIG. 6
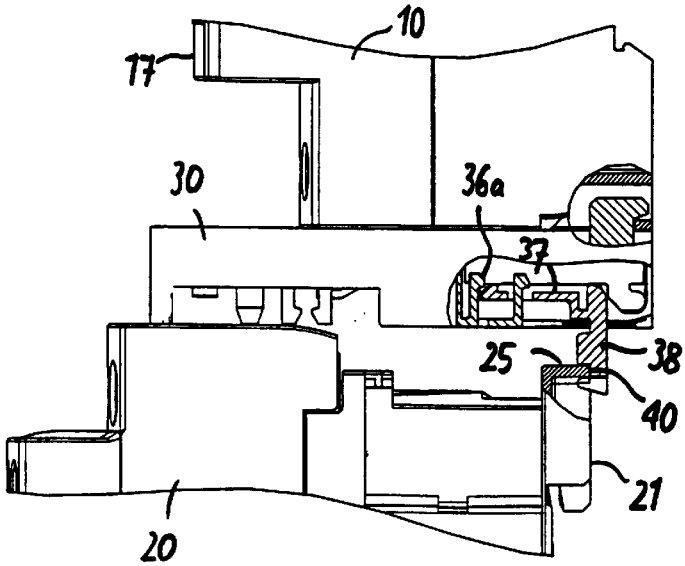

START-MOTOR ASSEMBLY

BACKGROUND OF THE INVENTION

1. Field of the Invention

The present invention concerns a switch assembly including a protection device and a contactor device, and a component for the mechanical association of the contactor device with the protection device and for electrical interconnection between the two devices, the component being intended to be placed in an intermediate position between the two devices and to be connected to power terminals of the two devices by respective pins pointing in opposite directions.

2. Discussion of the Background

The protection device may for example be a circuit breaker device or a fuse carrier device. An assembly is described in the document EP-588 712. The mechanical association of the contactor device with the circuit breaker device is achieved particularly by the engagement of a lug of the association component in a channel provided at the rear of the contactor device. Such an association component is specific to a single size of contactor device and, in order to fit different types of contactor devices to a same circuit breaker device, the only recourse is to use different intermediate components.

SUMMARY OF THE INVENTION

A purpose of the invention is to allow the easy and cheap assembly of switch assemblies, particularly for a motor-starter.

According to the invention, the association component has position adaptation means, particularly for fitting a protection device of fixed size to contactor devices of different sizes or for adjusting the relative position of the two devices of the switch assembly.

The association component preferably includes an insulating body fitted at the rear of at least one support element of one of the devices, the adaptation means allowing the choice of position of this support element in depth and/or in height. These adaptation means may comprise at least one lock-on lug which is intended to fix the association component to the contactor device and/or the protection device and which has a variable position, particularly by being provided on an adjustable part fixed to the association component, for example able to be snapped onto it in different positions staggered in depth, and/or fitted with support forms staggered in height.

It may be understood that the solution provided allows the cost of the switch assembly to be reduced.

BRIEF DESCRIPTION OF THE DRAWINGS

The description will be given below of a non-restrictive embodiment of the invention, with reference to the appended drawings.

FIG. 1 shows in side view a motor-starter assembly according to the invention.

FIGS. 2 and 3 are larger scale perspective views of the association component of the association component of the assembly in FIG. 1, the component being shown in two states allowing contactors of different sizes to be fitted.

FIGS. 4 to 6 show in side view a part of an assembly according to the invention, fitting to the same circuit breaker with contactors of different sizes.

The assembly in FIG. 1 includes a circuit breaker 10 and a contactor 20 assembled by means of an intermediate component 30. The circuit breaker 10 may be fixed at its rear part to a support such as a rail standardized by fixing elements 11 and comprises at a front part thereof power-on and power-off buttons 12. Such furthermore has upstream (top) power terminals 13 and downstream (bottom) power terminals 14. The contactor 20 has rear faces 21 and front faces 22, and upstream (top) power terminals 23 and downstream (bottom) power terminals 24. The intermediate component 30 is of relatively flat shape and includes an insulating body 31, and conductors integral with the body and connected by up pins 33 to the bottom terminals 14 of the circuit breaker and by down pins 34 to the top terminals 23 of the contactor. The pins shown are fixed, but could be adjustable so as to adapt to variable inter-terminal spacing.

The component 30 is kept on the circuit breaker by retaining elements such as lugs 32 engaging with channels 15, for example slots, provided in the casing of the circuit breaker (see FIG. 4), and by tightening the pins 33 in the terminals 14. The contactor is fixed under the component 30 by a lug 35 provided at the rear of a component 36 snapped on in an adjustable manner at the rear of the component 30, and by tightening the pins 34 in the terminals 23. Adjusting the position of the component 38 makes it possible to adjust the position of the lug 35 along the direction X, that is in depth.

The detachable component 36 is in the shape are of a set square fitted with a horizontal flange 37 for retention in the component 30 and a vertical flange 38 for supporting the contactor. The horizontal flange 37 is engaged against a notch, stop or similar support 36*a*, 36*b* of the body 31 of the component 30 and the vertical support flange 38 is fitted with two notches or other similar forms 39,40 onto which the rear part of the casing of the contactor locks. The component 30 is shown in the pushed back position in FIG. 2 and in the forward position in FIG. 3, the stop 36*b* being located further back than the stop 36*a*. The two notches 39, 40 allow the assembly of ribs 25 or of other forms of the contactor located at a variable height depending on the type of contactor relative to its upper face 26. This upper face 26 is defined by various stop elements and is applied against the bottom face of the component 30. The notches 39, 40 make it possible therefore to adapt the association component to the size of the contactor along the direction Z, i.e. in height.

In FIG. 4 can be seen the assembly of a contactor of small size (in depth) by a rib 25 engaged in the upper notch 39; in FIG. 5 the assembly of a contactor of large size (in depth), the component 30 being respectively in the forward position and the pushed back position. In these two cases, the contactor engages by a rib 25 with the upper notch 39 of the component 30. In FIG. 6 is shown the assembly of a contactor of large size (in height), i.e. the front part of which is higher than the rear part, its rib 25 is then located lower relative to its upper face 26 and is engaged in the bottom notch 40 of the component 30.

The invention is also aimed at the possibility of adjusting the position of the contactor relative to the circuit breaker by notches or adjustable parts associated with the component 30 on the circuit breaker side. On the other hand, the male and female forms which have been described may of course be reversed. According to circumstances, the adaptation may be operated on the position of the rear face 21 of the contactor relative to that of the rear face of the circuit breaker, or of the front face 22 of the contactor relative to the front face of the circuit breaker. The circuit breaker described may be replaced by a fuse carrier device or another similar protection device.

Obviously, numerous modifications and variations of the present invention are possible in light of the above teachings. It is therefore to be understood that within the scope of the appended claims, the invention may be practiced otherwise than as specifically described herein.

What is claimed is:

1. A switch assembly for interconnecting a protection device and a contactor device, which comprises:

a component for mechanically and electrically interconnecting the contactor device with the protection device, said component being positionable at an intermediate position between the two devices and being connected to power terminals of the protection device and the contact device, said respective pins pointing in opposite directions, wherein the association component has means for adapting the protection device when of a fixed size so as to be connectable to the contactor devices and wherein the size of the contactor device is variable.

2. An assembly according to claim 1, wherein the component includes an insulating body fitted at a rear portion thereof with at least one support element of one of the protection device and the contactor device, said means for adapting allowing at least one of a variable depth position of the support element.

3. An assembly according to claim 1, wherein the component includes an insulating body fitted at a rear portion thereof with a plurality of support elements of at least one of the protection device and the contactor device, said means for adapting allowing a variable height choice of position of the support element.

4. A switch assembly to be utilized for interconnecting a protection device and a contactor device, which comprises:

a component for mechanically detecting interconnecting the contactor device with the protection device, said component having at a rear portion hereof means comprising at least one lug for locking the component onto at least one of the contactor device and the protection device, and an adjustable part fixed to component, said adjustable part including means for adjusting one of a depth position and a height position of said adjustable part, said lug being positioned on said adjustable part.

5. An assembly according to claim 4, wherein said adjustable part is positionable at different positions at a rear portion of said component.

6. An assembly according to claim 4, wherein said lock-on lug is provided on a side of the adjustable part in which the contactor device is located and comprises a plurality of support forms for retaining additional elements positionable at a rear portion of the contactor device.

7. A switch assembly for interconnecting a protection device and a contactor device, which comprises:

a component for mechanically and electrically interconnecting the contactor device with the protection device, said component being positionable of an intermediate position between the two devices and being connected to power terminals of the protection device and the contact device, said respective pins pointing in opposite directions, wherein the association component has an adaptor for adapting the protection device when of a fixed size so as to be connectable to the contactor devices and wherein the size of the contactor device is variable.

8. An assembly according to claim 7, wherein the component includes an insulating body fitted at a rear portion thereof with at least one support element of one of the protection device and the contactor device, said adaptor allowing a variable depth position of the support element.

9. An assembly according to claim 7, wherein the component includes an insulating body fitted at a rear portion thereof with a plurality of support elements of at least one of the protection device and the contactor device, said adaptor allowing a variable height choice of position of the support element.

10. A switch assembly to be utilized for interconnecting a protection device and a contactor device, which comprises:

a component for mechanically detecting interconnecting the contactor device with the protection device, said component having at a rear portion thereof at least one lug for locking the component onto at least one of the contactor device and the protection device, and an adjustable part fixed to component, said adjustable part including a mechanism for adjusting a depth position of said adjustable part, said lug being positioned on said adjustable part.

11. An assembly according to claim 10, wherein said adjustable part is positionable at different positions at a rear portion of said component.

12. An assembly according to claim 10, wherein said lock-on lug is provided on a side of the adjustable part in which the contactor device is located and comprises a plurality of support forms for retaining additional elements positionable at a rear portion of the contactor device.

* * * * *